US008590807B2

(12) United States Patent
Callendret et al.

(10) Patent No.: US 8,590,807 B2
(45) Date of Patent: Nov. 26, 2013

(54) COATING MATERIAL ATOMIZER

(75) Inventors: Samuel Callendret, Grenoble (FR); Olivier Gourbat, Saint Egrève (FR); Sylvain Perinet, Giez (FR); Patrick Ballu, Reims (FR); Franck Gerstch, Meylan (FR); David Vincent, Grenoble (FR)

(73) Assignee: Sames Technologies, Meylan (FR)

( * ) Notice: Subject to any disclaimer, the term of this patent is extended or adjusted under 35 U.S.C. 154(b) by 327 days.

(21) Appl. No.: 13/131,555

(22) PCT Filed: Dec. 1, 2009

(86) PCT No.: PCT/FR2009/052359

§ 371 (c)(1),
(2), (4) Date: Jul. 28, 2011

(87) PCT Pub. No.: WO2010/063943

PCT Pub. Date: Jun. 10, 2010

(65) Prior Publication Data

US 2011/0277685 A1 Nov. 17, 2011

(30) Foreign Application Priority Data

Dec. 2, 2008 (FR) ..... 08 06770

(51) Int. Cl.

| | |
|---|---|
| ***B05B 3/10*** | (2006.01) |
| ***B44D 5/10*** | (2006.01) |
| ***F23D 11/04*** | (2006.01) |
| ***B05B 5/00*** | (2006.01) |
| ***F23D 11/32*** | (2006.01) |

(52) U.S. Cl.

USPC ..... 239/223; 239/224; 239/700; 239/701; 239/702; 239/703

(58) Field of Classification Search

USPC ..... 239/223, 224, 296, 700–703; 118/300–326

See application file for complete search history.

(56) References Cited

U.S. PATENT DOCUMENTS

| | | | | | |
|---|---|---|---|---|---|
| 4,776,520 | A | * | 10/1988 | Merritt | 239/700 |
| 5,820,036 | A | * | 10/1998 | Saito | 239/703 |
| 6,050,499 | A | * | 4/2000 | Takayama et al. | 239/112 |
| 2007/0063068 | A1 | * | 3/2007 | Seitz et al. | 239/223 |

FOREIGN PATENT DOCUMENTS

| | | | | |
|---|---|---|---|---|
| JP | 11300239 | | 2/1991 | |
| JP | 03284368 | | 12/1991 | |
| JP | 08131902 | | 11/1994 | |
| JP | 02095556 | | 7/1997 | |
| JP | 09192545 | * | 7/1997 | B05B 5/04 |
| JP | 09271696 | | 10/1997 | |

OTHER PUBLICATIONS

International Search Report for PCT/FR2009/052359; Dated Feb. 16, 2010.

* cited by examiner

*Primary Examiner* — Len Tran
*Assistant Examiner* — Alexander M Valvis
(74) *Attorney, Agent, or Firm* — Robert M. Gould; Husch Blackwell, LLP

(57) ABSTRACT

The present disclosure describes an atomizer having a body with an inner portion and an outer portion; an atomizer member; and outlet channels about the spraying axis ($X_1$) for ejecting air so as to shape the spray of material. The atomizer also has an outlet chamber communicating with the outlet channels; and an inlet duct for feeding air to the outlet channels. The atomizer also includes at least two intermediate chambers juxtaposed and extending about the spraying axis ($X_1$); axial intermediate channels, two juxtaposed intermediate chambers being interconnected via a set of intermediate channels distributed about the spraying axis ($X_1$); and outlet ducts distributed about the spraying axis ($X_1$).

14 Claims, 4 Drawing Sheets

COATING MATERIAL ATOMIZER

RELATED APPLICATIONS

The present application is a §371 U.S. national stage entry of International Application No. PCT/FR2009/052359, filed Dec. 1, 2009, which claims the priority of France patent application No. 08 06770 filed Dec. 2, 2008, all of which are incorporated herein by reference in its entirety.

FIELD

The present invention relates to a rotary atomizer for spraying a coating material, which atomizer includes outlet channels distributed around the spraying axis in order to eject air so as to shape the spray of coating material.

BACKGROUND

In the present patent application, the term "coating material" is used to designate any material in liquid or in powder form that is to be sprayed towards an article to be coated, e.g. a primer, a paint, or a varnish.

U.S. Pat. No. 4,776,520 describes a rotary atomizer for spraying liquid paint. That rotary atomizer has a body comprising a main inner portion and an outer portion fastened to the inner portion, by screw-fastening. The rotary atomizer of U.S. Pat. No. 4,776,520 also has an atomizer member for atomizing the coating material, and a turbine. The atomizer member is arranged at a downstream end of the body in such a manner as to form a spray of paint, when said atomizer member is driven in rotation by the turbine. Outlet channels are provided in the body, uniformly about the axis of rotation. The function of the outlet channels is to eject air so as to shape the spray of paint, these jets of air usually being referred to as "shroud air". The rotary atomizer also has an outlet chamber that is formed in the body and that extends about the axis of rotation. The outlet chamber communicates with each outlet channel. Upstream from the outlet chamber, an inlet duct is provided in the body so as to feed compressed air to the outlet chamber and thus to the outlet channels.

It is observed that the flow rates of shroud air flowing through the respective outlet channels are not distributed uniformly about the axis of rotation. A single inlet duct brings air into the annular outlet chamber. That annular outlet chamber generates head losses that increase with increasing distance from the inlet duct. That non-uniform distribution of the flow rates of air might, if it is not controlled, cause undesired asymmetry in the spray of coating material, and thus in the thickness of the layer of coating material deposited on the article to be coated, in particular while the rotary atomizer is moving facing the article to be coated.

A particular object of the invention is to remedy those drawbacks, by proposing a rotary atomizer that achieves controlled distribution, e.g. uniform and symmetrical distribution, of the shroud air about the spraying axis, with limited air consumption.

SUMMARY

To this end, the invention provides a coating material atomizer comprising:

a body comprising an inner portion and an outer portion;

an atomizer member for atomizing the coating material, which ember is arranged at a downstream end of the body so as to form a spray of coating material, the atomizer member being centered on a spraying axis;

outlet channels distributed about the spraying axis, each outlet channel being provided in the body in such a manner as to eject air so as to shape the spray of coating material;

at least one outlet chamber formed between the inner portion and the outer portion, the outlet chamber extending about the spraying axis, the outlet chamber communicating with the outlet channels; and at least one inlet duct provided in the body, the inlet duct being designed to feed air to the outlet channels;

The atomizer is characterized in that it further comprises:

at least two intermediate chambers juxtaposed along the spraying axis, each intermediate chamber being formed between the inner portion and the outer portion, each intermediate chamber extending about the spraying axis, at least one inlet duct communicating with the intermediate chamber that is axially furthest from the atomizer member;

intermediate channels formed between the inner portion and the outer portion, two juxtaposed intermediate chambers being interconnected via a set of intermediate channels, the intermediate channels of the same set being distributed about the spraying axis; and outlet ducts extending between the intermediate chamber that is axially closest to the atomizer member and the outlet chamber, the outlet ducts being distributed about the spraying axis.

By means of the invention, the two chambers and the intermediate channels make it possible to distribute the flow of air towards the outlet chamber, in controlled manner, about the spraying axis.

According to other advantageous but optional characteristics of the invention, taken in isolation or in any technically feasible combination:

the ratio between the number of outlet ducts and the number of intermediate channels belonging to the set interconnecting the two intermediate chambers that are axially closest to the atomizer member is greater than or equal to 0.25;

the number of outlet ducts is greater than or equal to 4, and preferably greater than or equal to 8;

the intermediate channels belonging to the same set are distributed about the spraying axis and the outlet ducts are distributed about the axis;

the number of intermediate chambers lies in the range 2 to 8;

the number of outlet ducts is greater than 4, and preferably equal to 8, the ratio between the number of intermediate channels belonging to the set interconnecting the two intermediate chambers that are axially closest to the atomizer member, and the number of intermediate channels belonging to the set interconnecting the two intermediate chambers that are axially furthest from the atomizer member lies in the range 1.5 to 10, and is preferably equal to 2;

a total flow section of the intermediate channels belonging to a set interconnecting two intermediate chambers axially further from the atomizer member is less than or equal to a total flow section of the intermediate channels belonging to a set interconnecting two intermediate chambers axially closer to the atomizer member;

the intermediate channels of the same set have respective flow sections that are substantially mutually identical, and the outlet ducts have respective flow sections that are substantially mutually identical;

the total flow section of the outlet ducts is greater than or equal to the total flow section of the inlet duct(s), the total flow section of the outlet ducts is greater than or equal to a total flow section of the intermediate channels belonging to the same set, and a total flow section of the intermediate channels belonging to the same set is greater than or equal to the total flow section of the inlet duct(s);

the intermediate chambers and the outlet chamber are each of annular shape that is circularly symmetrical about the spraying axis;

each intermediate chamber is constituted by an annular groove, and each intermediate channel is constituted by a notch extending parallel to the spraying axis, each groove and each notch is formed by a respective recess in the inner portion and/or in the outer portion, and the outer portion and the inner portion have overall shapes that are mutually complementary, so as to cover each recess entirely;

the intermediate channels belonging to the same set occupy angular positions about the spraying axis that are offset angularly about the spraying axis relative to the intermediate channels belonging to a juxtaposed set;

the atomizer further comprises at least one ring that is mounted to move in rotation about the spraying axis, and the set of intermediate channels is formed in said moving ring; and each intermediate chamber and each intermediate channel are formed by cavities in a porous part.

The invention can be well understood and its advantages also appear from the following description, given merely by way of non-limiting example and with reference to the accompanying drawings, in which:

FIGURES

DETAILED DESCRIPTION

Figure 1:
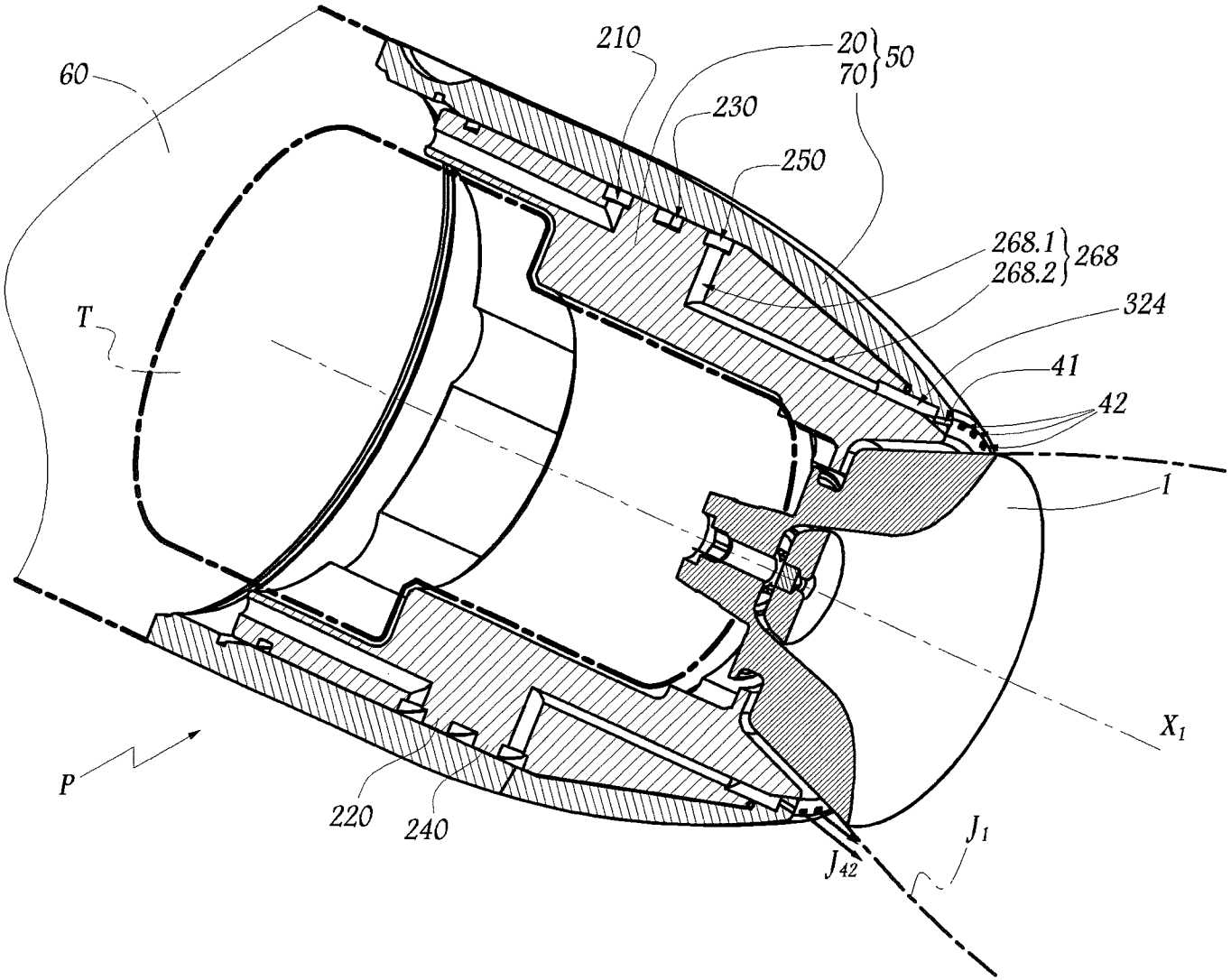
FIG. 1 is a truncated perspective view of a first embodiment of a rotary atomizer of the invention.

FIG. 1 shows a rotary atomizer P for spraying a liquid coating material. This rotary atomizer includes an atomizer member for atomizing the coating material, which member is referred to bellow as a "bell cup" 1 as is usual in view of its shape. The bell cup 1 is arranged at a downstream end of a body 50. The bell cup 1 is shown in an atomization position, in which it is driven in rotation at high speed about an axis $X_1$ by drive means comprising a compressed-air turbine T having a casing that is shown in chain-dotted lines in FIG. 1. The axis $X_1$ thus constitutes an axis of rotation for the bell cup 1. The axis $X_1$ forms a spraying axis for the atomizer P.

Figure The body 50 is stationary, i.e. it does not rotate about the axis $X_1$. The body 50 may be mounted on a base 60 of the atomizer P that is shown in part in chain-dotted lines in FIG. 1, and that is itself designed to be mounted on a wrist of a multi-axis robot arm (not shown). The body 50 comprises an inner portion 20 and an outer portion 70. The outer portion 70 is usually referred to as the "shroud". The outer portion 70 and the inner portion 20 are fasten with each other, i.e. they are formed integrally as a single part, or they are separate secured-together parts. In this example, the outer portion 70 is secured to the inner portion 20, e.g. by screw-fastening. The overall shape of the outer portion 70 is that of a truncated bullet, converging towards the downstream end of the body 50.

In the present patent application, the adjective "inner" designates an element relatively close to the axis $X_1$, while the adjective "outer" designates an element that is further away therefrom, or that faces away therefrom. In the present patent application, the adjective "proximal" designates an element relatively close to the base 60, whereas the adjective "distal" designates an element that is further away therefrom.

The bell cup 1 has a concave shape and is circularly symmetrical about the axis $X_1$. As is known per se, the bell cup 1 makes it possible to atomize the coating material into fine droplets. All of the droplets together form a spray of material $J_1$ shown in chain-dotted lines in FIG. 1, which spray leaves the bell cup 1 and is directed towards an article to be coated (not shown) on which article the spray of material $J_1$ forms an impact.

In order to shape the spray of material $J_1$ the atomizer P has outlet channels 41 that are distributed about the axis $X_1$ and that open out at the downstream end of the body 50 into orifices 42. In operation, a jet of air $J_{42}$ exits from each orifice 42 extending an outlet channel 41. The jets of air $J_{42}$ make it possible to shape the spray of material $J_1$ and to guide it towards the article to be coated. Each outlet channel 41 is provided in the body 50, i.e. in the inner portion 20 or in the outer portion 70. In this example, each outlet channel 41 is provided through the downstream portion of the distal portion 40. In practice, each outlet channel may be provided differently.

In order to bring compressed air to the outlet channels 41, an outlet chamber 324 is formed, at the downstream end of the inner portion 20, between the inner portion 20 and the outer portion 70. The outlet chamber 324 is of circularly symmetrical annular shape extending about the axis $X_1$ and immediately upstream from the outlet channels 41. The outlet chamber 324 communicates with the outlet channels 41.

In addition, the atomizer P has two inlet ducts 201 and 202 that are provided in the body 50 in such a manner as to feed air to the outlet chamber 324, and thus to the outlet channels 42.

In the present application, the terms "inlet", "outlet", "upstream", and "downstream" are used with reference to the general direction of flow of the compressed air through the atomizer P, from the interface between the atomizer P and the base 60, which interface defines an upstream inlet, to the outlet channels 42 that define downstream outlets.

Figure 2:
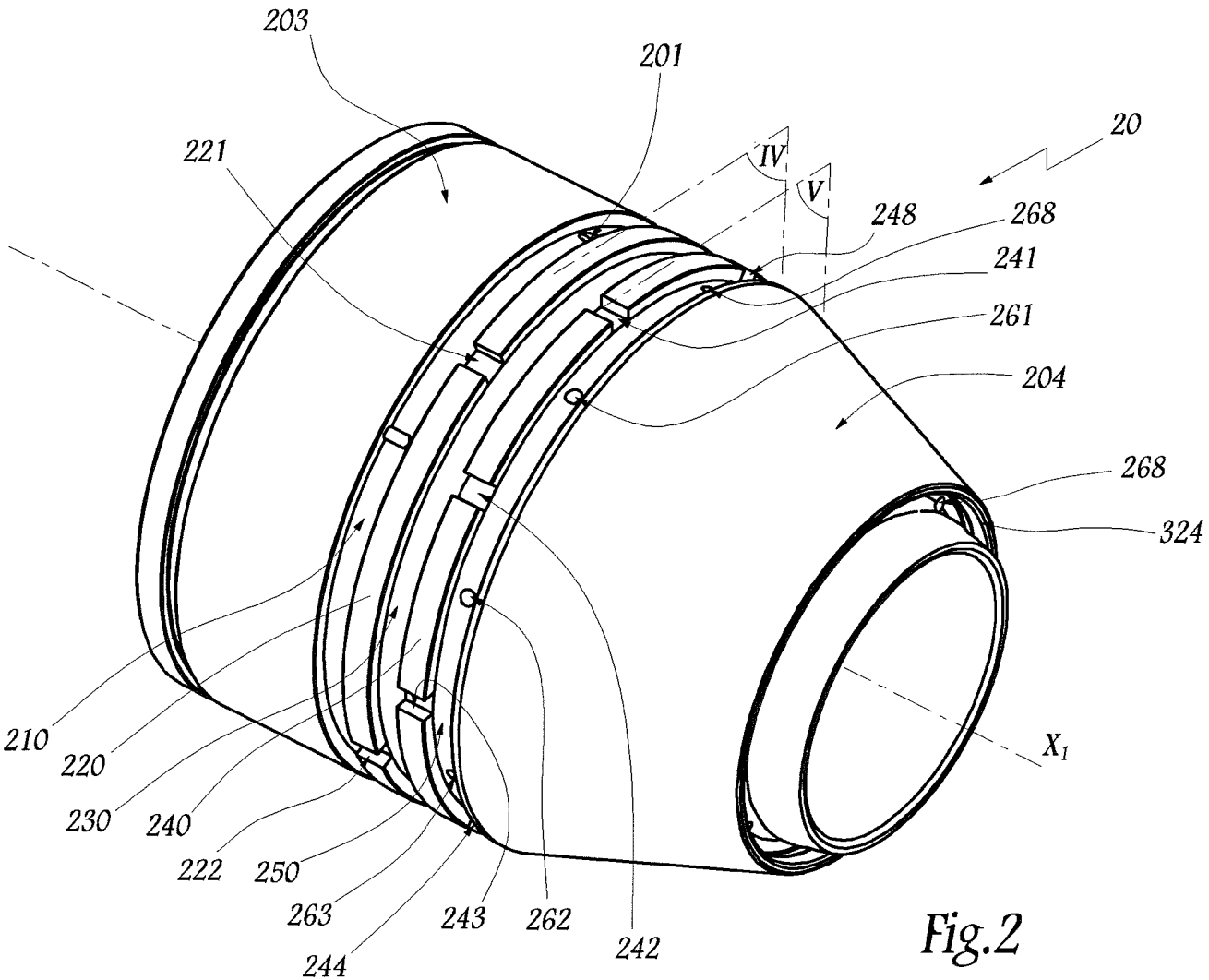
FIG. 2 is a perspective view on a larger scale and from a different angle than the FIG. 1 view, showing a portion of the atomizer of FIG. 1.

As shown in FIG. 2, the inner portion 20 is made up overall of a proximal portion 203 and of a distal portion 204, the proximal portion being in the overall shape of a cylinder having a circular base of axis $X_1$, and the distal portion being frustoconical in overall shape, and being of overall size that is smaller than the overall size of the proximal portion 203. The inner portion 20 is tubular so as to house the turbine T.

In the present patent application, the term "chamber" is used to designate an enclosure, i.e. a hollow volume that is entirely delimited by walls. Such a chamber has openings making it possible for fluid to flow respectively into and out of the chamber.

In the present patent application, the terms "interconnect", "connect", and "communicate" refer to fluid communication, in particular compressed air communication, i.e. to a link enabling a gaseous or liquid fluid to flow between two or more points or parts. Such a link may be direct or indirect, i.e. formed by a duct, by a pipe, or by a channel etc. Similarly, the nouns derived from these verbs, such as "interconnection" and "connection", concern such fluid communication.

In the present patent application, the terms "feed", "inject", and "eject" refer to a flow of fluid, in particular a flow of compressed air.

Figure 3:
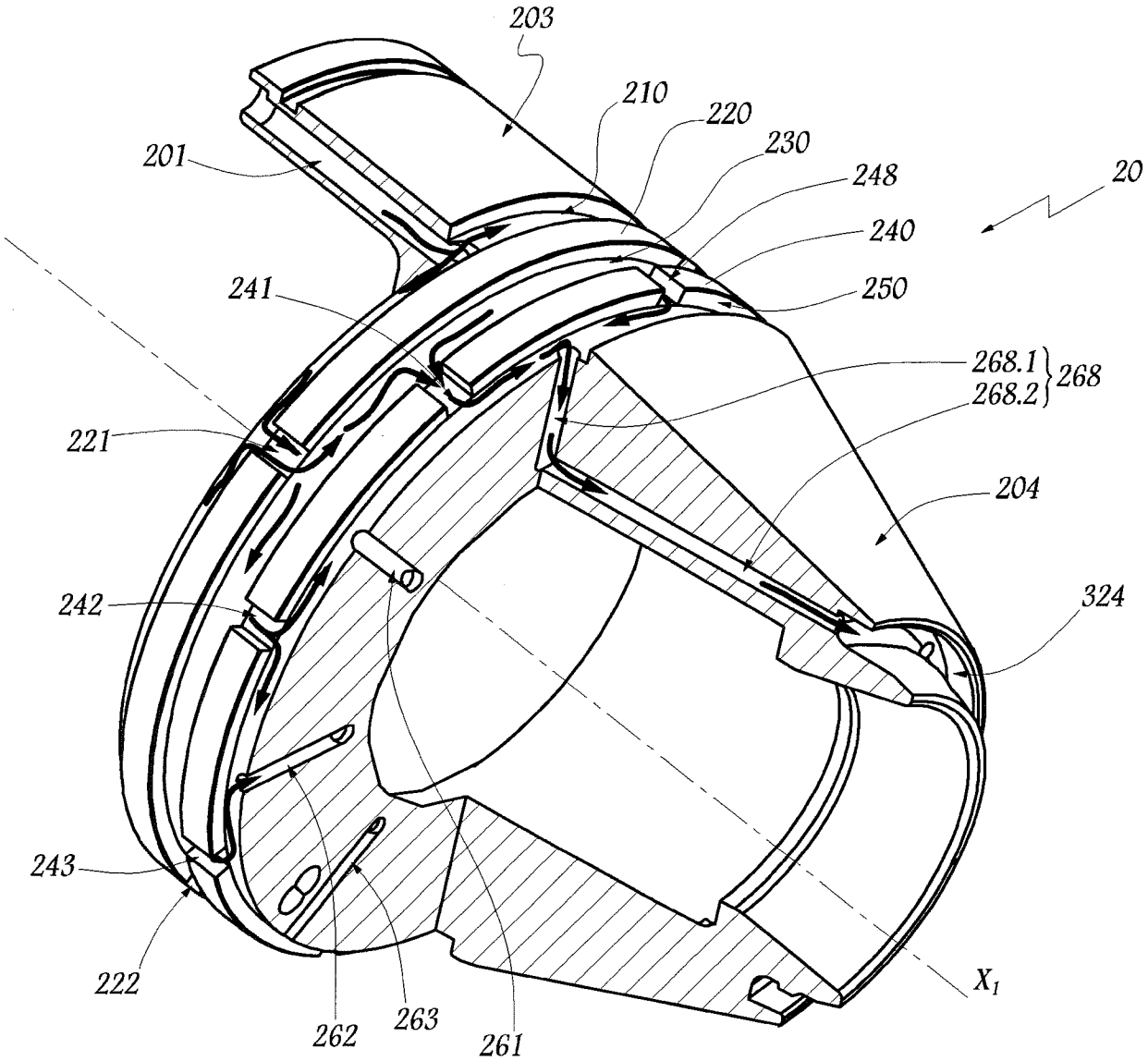
FIG. 3 is a cut-away perspective view from an angle different from the FIG. 2 view, showing the FIG. 2 portion of the atomizer.

As shown in FIGS. 1 to 3, the inlet ducts 201 and 202 extend through the thickness of the proximal portion 203 and along the axis $X_1$. The inlet ducts 201 and 202 are, in this example, diametrically opposite about the axis $X_1$. Alternatively, the inlet ducts may occupy other angular positions about the spraying axis. Upstream, the inlet ducts 201 are connected to a compressed air feed duct (not shown).

As shown in FIGS. 1 and 2, three intermediate chambers 210, 230, and 250 are juxtaposed along the axis $X_1$ at the proximal portion 203 and between the distal portion 204 and the inlet ducts 201 and 202. Each intermediate chamber 210, 230, or 250 is circularly annular in overall shape about the axis $X_1$. Thus, each intermediate chamber 210, 230, or 250 extends about the axis $X_1$. Each intermediate chamber 210, 230, or 250 is formed between the inner portion 20 and the outer portion 70. The inlet duct 201 opens out into the intermediate chamber 210 that is axially furthest away from the bell cup 1.

In the present patent application, the terms "axial", "radial", "axially", and "radially" are used with reference to the axis $X_1$ that is the axis of rotation of the bell cup of the rotary atomizer.

The intermediate chambers 210, 230, and 250 are mutually parallel. The intermediate chambers 210 and 230 are separated by a first rib 220 that is circularly annular in overall shape about the axis $X_1$. The intermediate chambers 230 and 250 are separated by a second rib 240 that is circularly annular in overall shape about the axis $X_1$. The outside diameter of the first rib 220 and of the second rib 240 corresponds to the outside diameter of the proximal portion 203 and to the inside diameter of the outer portion 70. Thus, the radially outer surfaces of the first rib 220 and of the second rib 240 bear against the inside cylindrical surface of the outer portion, thereby making their interface substantially impermeable to compressed air.

Figure 5:
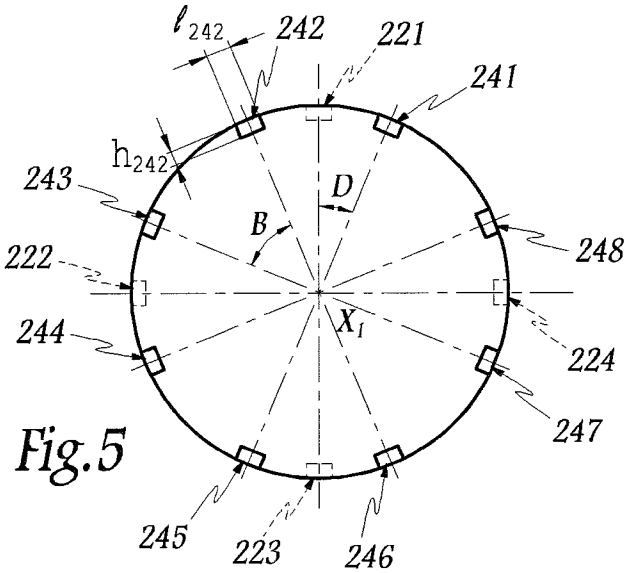
FIG. 5 is a diagrammatic section view on plane V of FIG. 2.
Figure 4:
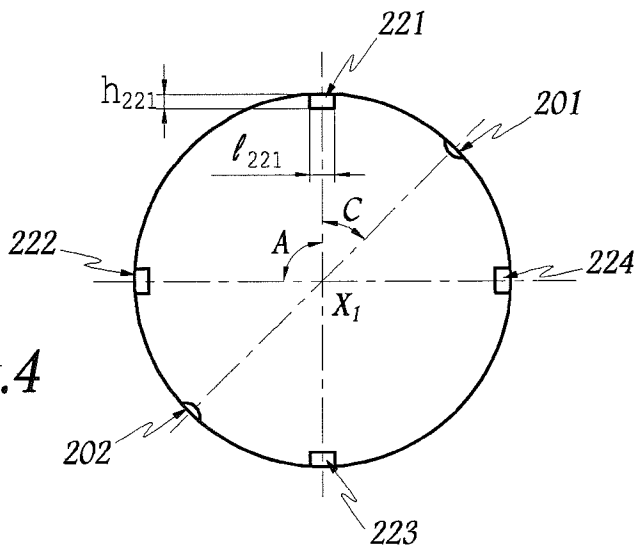
FIG. 4 is a diagrammatic section view on plane IV of FIG. 2.

Four intermediate channels 221, 222, 223, and 224 are provided in the first rib 220, which channels can be seen in FIGS. 4 and 5, and, for two of them, in FIGS. 2 and 3. These four intermediate channels 221 to 224 extend parallel to the axis $X_1$ between the intermediate chambers 210 to 230. These four intermediate channels 221 to 224 thus open out firstly into the intermediate chamber 210 and secondly into the intermediate chamber 230. In practice, the intermediate channels extend in a direction having an axial component, it being possible for this direction to be non-parallel to the spraying axis.

Similarly, eight intermediate channels 241, 242, 243, 244, 245, 246, 247, and 248 are provided in the second rib 240, which channels can be seen in FIGS. 4 and 5, and, for four of them, in FIGS. 2 and 3. The intermediate channels 241 to 248 extend parallel to the axis $X_1$ between the intermediate chambers 230 and 250. Each intermediate channel 241, 242, 243, 244, 245, 246, 247, or 248 thus opens out into the intermediate chamber 230 and into the intermediate chamber 250.

The intermediate channels 221 to 224 form a first set of intermediate channels. The intermediate chambers 210 and 230 are thus interconnected via the first set of intermediate channels, namely the intermediate channels 221 to 224. The intermediate channels 241 to 248 form a second set of intermediate channels. The intermediate channels 230 and 250 are thus interconnected via the second set of intermediate channels, namely the intermediate channels 241 to 248. Thus, two intermediate chambers that are juxtaposed along the axis $X_1$ are interconnected via a set of intermediate channels.

The ratio between the number of intermediate channels 241 to 248 that belong to the second set interconnecting the intermediate chambers 230 and 250 that are axially closest to the bell cup and the number of intermediate channels 221 to 224 that belong to the first set interconnecting the intermediate chambers 210 and 230 that are axially furthest from the bell cup is equal to 2 in this example, because there are four intermediate channels 221 to 224 and eight intermediate channels 241 to 248.

In practice this ratio between the numbers of intermediate channels belonging to the sets interconnecting respectively the intermediate chambers that are axially closest to the bell cup and the intermediate chambers that are axially furthest from the bell cup lies in the range 1.5 to 10, and is preferably 2.

Each intermediate channel 221 to 224 and 241 to 248 is constituted by a notch that extends parallel to the axis $X_1$. Each of these notches is formed by a respective recess in the outside surface of the inner portion 20. The intermediate channels 221 to 224 and 241 to 248 make it possible for air to flow between the intermediate chambers 210, 230 and 250.

Each intermediate chamber 210, 230 or 250 is constituted by a groove having a circularly tubular section on a plane transverse to the axis $X_1$. Each of the grooves is formed by a respective recess in the outside surface of the inner portion 20. The intermediate chambers 210, 230, and 250 guide the flow of air between the inlet duct 201 and the outlet ducts 261, 262, 263, 268 & equivalent that are described below.

The outer portion 70 has an overall shape that is complementary to the shape of the inner portion 20. These complementary shapes of the outer portion and of the inner portion 20 are determined so that the outer portion totally covers each of the recesses in the inner portion 20, i.e. each intermediate chamber 210, 230 or 250, and each intermediate channel 241 to 248. In other words, the intermediate chambers 210, 230, and 250, and the intermediate channels 221 to 224 and 241 to 248 are thus formed between the inner portion 20 and the outer portion 70.

In addition, in the first embodiment shown in FIGS. 1 to 5, the rotary atomizer P has eight outlet ducts, four of which can be seen in FIGS. 2 and 3, with the references 261, 262, 263, and 268. As shown in FIG. 2, each outlet duct 261, 262, 263, 268 or equivalent extends in the inner portion 20, between the outlet chamber 324 and the intermediate chamber 250 that is axially closest to the bell cup 1. Like the intermediate channels 221 to 224 and 241 to 248, the outlet ducts 261, 262, 263, 268 & equivalent are distributed uniformly about the axis $X_1$.

As appears more particularly for the outlet duct 268 in FIG. 3, each outlet duct 261, 262, 263, 268 or equivalent is made up of a radial segment 268.1 and of an axial segment 268.2 that are provided through the distal portion 204. The radial and axial segments of the outlet ducts 261, 262, 263, 268 & equivalent are cylindrical and have diameters that are mutually identical.

In order to make the flow rates of air flowing through the outlet channels of type 41 uniform, the body 50 is structured in such a manner as to equalize the air pressures prevailing about the axis $X_1$ in the outlet chamber 324. To this end, the intermediate channels of the same set are distributed about the axis $X_1$. The term "distributed" designates intermediate channels that are distributed over the entire circumference of the first rib 220 or of the second rib 240. In other words, the intermediate channels of the same set are not concentrated in a narrow angular sector, but rather they are "spread out" about the axis $X_1$.

More particularly, in the embodiment shown in FIGS. 2 to 5, the intermediate channels 221 to 224 or 241 to 248 of the same set are distributed uniformly about the axis $X_1$, so that two successive intermediate channels in a circumferential direction are separated by a constant angle. Two adjacent intermediate channels 221 to 224 form an angle A of about 90°. In practice, the angle A lies in the range 60° to 120°. Two adjacent intermediate channels 241 to 248 form an angle B of about 45°. In practice, the angle B lies in the range 30° to 60°.

The number of outlet ducts 261, 262, 263, 268 & equivalent, namely eight, is, in this example, equal to the number of intermediate channels 241 to 248 belonging to the second set that interconnect the intermediate chambers 230 and 250 that are axially closest to the bell cup 1. The ratio between the number of outlet ducts 261, 262, 263, 268 & equivalent, and the number of intermediate channels 241 to 248 is thus equal to 1.

In practice, the number of outlet ducts is greater than or equal to four, and the ratio between the number of outlet ducts and the number of intermediate channels belonging to the set interconnecting the two intermediate chambers that are axially closest to the atomizer member, i.e. the "downstream" set, is greater than or equal to 0.25. This ratio is equal to 0.25 when, for example, there are four outlet ducts and thirty-two intermediate channels belonging to the "downstream" set. Such a ratio makes it possible to equalize the air pressures in the intermediate chamber 250, i.e. upstream from the outlet ducts 261, 262, 263, 268 & equivalent.

In order to ensure a relatively uniform distribution of the flow rates of air flowing through the intermediate channels 221 to 224, and 241 to 248, the intermediate channels of the same set, namely of the first set or of the second set, have flow sections that are substantially mutually identical.

In the example of FIGS. 4 and 5, the flow section of each intermediate channel 221 to 224 is approximately rectangular, of width l221 and of height h221. The width l221 is about 4 millimeters (mm). The height h221 is about 2 mm.

Similarly, the intermediate channels 241 to 248 of the second set have flow sections that are mutually identical, of approximately rectangular shape, of width l242 and of height h242. In practice, the intermediate channels of the same set may be of any shape.

FIG. 3 indicates the flows of air by means of curved arrows. As shown by these arrows, a rotary atomizer of the invention makes it possible to distribute air pressures and air flow rates uniformly from the inlet ducts 201 and 202 to the outlet chamber 324.

As shown in FIG. 4, the intermediate channels 221 to 224, of the first set, occupy angular positions that are symmetrical about the axis $X_1$ since they are separated successively by the constant angle A. As shown in FIG. 5, the intermediate channels 241 to 248 of the second set occupy angular positions that are symmetrical about the axis $X_1$ since they are separated successively by the constant angle B.

In addition, each of the intermediate channels 221 to 224 occupies an angular position that is offset relative to the inlet duct 201. In other words, the inlet duct 201 and one of the intermediate channels 221 to 224 forms an angle C about the axis $X_1$ that is non-zero and that is approximately equal to 45°.

The angular position of an intermediate channel is defined in a plane orthogonal to the axis $X_1$ and with reference to a substantially middle axis of said intermediate channel, such an axis being shown in chain-dotted lines in FIGS. 4 and 5.

As shown in FIG. 5, each of the intermediate channels 241 to 248 occupies an angular position that is offset relative to the intermediate channels 221 to 224. In other words, an intermediate channel 241 to 248 and an intermediate channel 221 to 224 that are adjacent to each other form an angle D about the axis $X_1$ that is non-zero and that is approximately equal to 22.5°.

Thus, the intermediate chambers 210, 230, and 250 and the intermediate channels 221 to 224, and 241 to 248 define a sort of labyrinth that constrains the air injected via the inlet duct 201 to be distributed uniformly about the axis $X_1$.

In addition, the total flow section of the outlet channels 42 is greater than or equal to the total flow section of the inlet ducts 201 and 202. In addition, the total flow section of the outlet channels is greater than or equal to a total flow section of the intermediate channels 221 to 224 or 241 to 248 belonging to the same set, namely either the first set or the second set. In addition, the total flow section of the intermediate channels 221 to 224 or 241 to 248 belonging to the same set, namely either the first set or the second set, is greater than or equal to the total flow section of the inlet duct 201.

The term "flow section" designates the section through which compressed air can flow. The term "total flow section" designates the sum of the unitary flow sections of a plurality of mutually identical elements, such as the intermediate channels of the same set, or the outlet ducts.

More generally, the total flow section increases going from upstream to downstream, at each "flow" component of the labyrinth, thereby limiting the head losses and avoiding a local increase in air pressure that would tend to unbalance the shroud air.

For this purpose, the total flow section, i.e. 4×l221×h221, of the intermediate channels 221 to 224 of the first set, which channels interconnect the intermediate chambers 210 and 230 that are axially furthest from the bell cup 1, is less than the total flow section, i.e. 8×l241×h241, of the intermediate channels 241 to 248 of the second set, which channels interconnect the intermediate chambers 230 and 250 that are axially closest to the bell cup 1.

In addition, the rotary atomizer further includes an air deflector member that is situated in the outlet chamber 324 and that also makes it possible to improve the uniformity of the air pressures about the axis $X_1$.

The body shown in FIGS. 2 to 5 has three intermediate chambers 210, 230, and 250. In practice, the number of intermediate chambers lies in the range two to eight.

Figure 7:
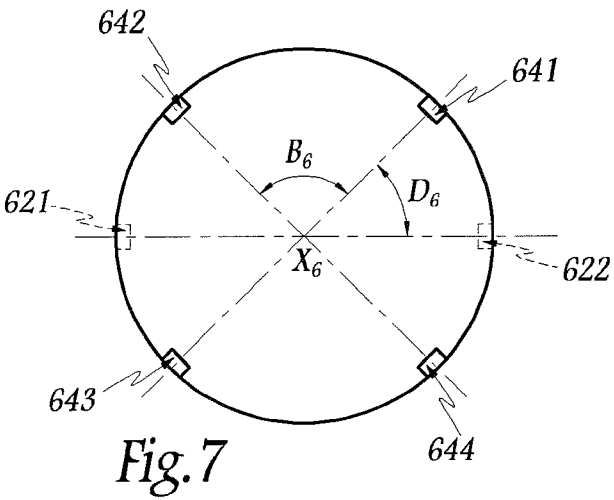
FIG. 7 is a section view analogous to FIG. 5 through the FIG. 6 atomizer.
Figure 6:
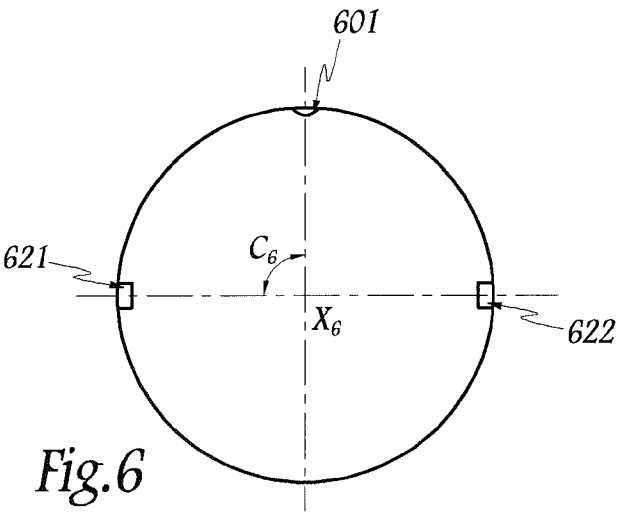
FIG. 6 is a section view analogous to FIG. 4, through a second embodiment of an atomizer of the invention.

FIGS. 6 and 7 show a portion of a variant of the atomizer of FIGS. 1 to 5, in which the body has a single inlet duct 601 and two juxtaposed chambers. The first set of intermediate channels then comprises two intermediate channels 621 and 622 that are diametrically opposite and that are offset, in a plane transverse to the spraying axis X6, by an angle C6, analogous to the angle C, of about 90° relative to the inlet duct 601. The second set of intermediate channels comprises four intermediate channels 641, 642, 643, and 644 separated from one another by an angle B6, analogous to the angle B, of about 90°, and distributed angularly between the intermediate channels 621 and 622 of the first set, the offset angle $D_6$ analogous to the angle D being about 45°. Thus, the air pressures and air flow rates are distributed uniformly between each of the intermediate channels, thereby forming balanced or symmetrical shroud air.

In the example described above, the distribution of the shroud air flow rates about the spraying axis is controlled uniformly and symmetrically. In a variant (not shown), an atomizer of the invention includes at least one moving ring that is mounted to move in rotation about the spraying axis. One of the sets of intermediate channels, and thus a rib of type 220 or 240, is formed in said moving ring.

Such a moving ring makes it possible to adjust the relative angular position of the intermediate channels of said set relative to the channels of a juxtaposed set, typically the angle D or $D_6$. Thus, the distribution of the shroud air flow rates about the spraying axis is controlled. For example, if intermediate channels are placed facing other intermediate channels, the air flow rates are distributed in non-uniform and controlled manner about the spraying axis. It is thus possible to generate shroud air that is elliptical in overall shape rather than circular as in the variant shown in FIGS. 1 to 7. It is also possible to provide a plurality of rings mounted to move in rotation independently of one another, in order to adjust the flow rates of shroud air.

In another variant (not shown), the body can include a plurality of intermediate chambers in the form of disjoint annular portions about the axis of rotation.

In another variant (not shown), the grooves and notches that respectively form the intermediate chambers and the intermediate channels are formed in the outer portion of the body, such as the outer portion 70. The intermediate chambers and the intermediate channels are then covered by the inner portion that is of overall shape complementary to the outer portion.

In another variant (not shown), the atomizer has two or more inlet ducts that inject compressed air into respective ones of distinct intermediate chambers, e.g. the intermediate chamber axially furthest from the bell cup and the intermediate chamber juxtaposed to said intermediate chamber that is axially furthest from the bell cup. In any event, such inlet ducts are designed to feed air to the outlet channels, like the inlet ducts 201 and 202.

In another variant (not shown), the intermediate channels of the same set, namely the first or the second set, may have respective flow sections that are different. In which case, the respective flow sections of each intermediate channel are determined as a function of the distance between the respective intermediate channel and the closest air intake, inlet duct, or upstream intermediate channel. For example, an intermediate channel may have a flow section greater than the flow section of its adjacent intermediate channel in the set, in particular if it is placed further from the air intake. Such dimensioning ensures that the flow rates of air flowing through the intermediate channels of the same set are distributed relatively uniformly.

In yet another variant (not shown), the intermediate chambers and the intermediate channels are formed in one or more porous parts made of one or more porous materials, such as a polymer foam, a sintered part made of a plastics material or of a metal material, or of any other material of sufficient porosity, in which the cavities and the connections therebetween form the successive intermediate chambers and intermediate channels. This porous part is mounted on a non-porous portion, such as the above-mentioned inner portion 20. The intermediate chambers and the intermediate channels can then have irregular geometrical shapes because they are respectively constituted by cavities or by porosities in the porous part. In order to distribute the air pressures and air flow rates in the intermediate chambers and in the intermediate channels, provision is made for the porosity of the part to be lower close to the inlet duct(s) and higher far away from the inlet ducts.

The invention is also applicable to an atomizer having a plurality of groups of outlet channels, each of which ejects shroud air that is annular in overall shape. Such an atomizer then has two disjoint groups, each of which has one or more inlet ducts, at least two intermediate chambers, sets of intermediate channels, outlet ducts, and outlet channels.

The invention is shown with a rotary atomizer provided with a bell cup 1 mounted to rotate about the axis $X_1$. However, it is applicable to an atomizer or to a spray gun having a stationary nozzle, the nozzle being centered on a spraying axis. Although described with reference to an atomizer for spraying a liquid material, the invention is applicable to atomizers for spraying powder materials.

The invention claimed is:

1. A coating material rotary atomizer comprising:

a body comprising an inner portion and an outer portion;

an atomizer member for atomizing the coating material, which member is arranged at a downstream end of the body so as to form a spray of coating material, the atomizer member being centered on a spraying axis;

outlet channels distributed about the spraying axis, each outlet channel being provided in the body in such a manner as to eject air so as to shape the spray of coating material;

at least one outlet chamber formed between the inner portion and the outer portion, the outlet chamber extending about the spraying axis, the outlet chamber communicating with the outlet channels; and at least one inlet duct provided in the body, the inlet duct being designed to feed air to the outlet channels;

at least three intermediate chambers juxtaposed along the spraying axis, each intermediate chamber being formed between the inner portion and the outer portion, each intermediate chamber extending about the spraying axis, at least one inlet duct communicating with the intermediate chamber that is axially furthest from the atomizer member;

intermediate channels formed between the inner portion and the outer portion, two juxtaposed intermediate chambers being interconnected via a set of intermediate channels, the intermediate channels of the same set being distributed about the spraying axis; and outlet ducts extending between the intermediate chamber that is axially closest to the atomizer member and the outlet chamber, the outlet ducts being distributed about the spraying axis, wherein the intermediate channels belonging to the same set occupy angular positions about the spraying axis that are offset angularly about the spraying axis relative to the intermediate channels belonging to a juxtaposed set.

2. An atomizer according to claim 1, wherein the ratio between the number of outlet ducts and the number of intermediate channels belonging to the set interconnecting the two intermediate chambers that are axially closest to the atomizer member is greater than or equal to 0.25.

3. An atomizer according to claim 1, wherein the number of outlet ducts is greater than or equal to 4, and preferably greater than or equal to 8.

4. An atomizer according to claim 1, wherein the intermediate channels belonging to the same set are distributed about the spraying axis and in that the outlet ducts are distributed about the axis.

5. An atomizer according to claim 1, wherein the number of intermediate chambers lies in the range 2 to 8.

6. An atomizer according to claim 3, wherein the number of outlet ducts is greater than 4, and preferably equal to 8, wherein the ratio between the number of intermediate channels belonging to the set interconnecting the two intermediate chambers that are axially closest to the atomizer member, and the number of intermediate channels belonging to the set interconnecting the two intermediate chambers that are axially furthest from the atomizer member lies in the range 1.5 to 10, and is preferably equal to 2.

7. An atomizer according to claim 3, wherein a total flow section of the intermediate channels belonging to a set interconnecting two intermediate chambers axially further from the atomizer member is less than or equal to a total flow section of the intermediate channels belonging to a set interconnecting two intermediate chambers axially closer to the atomizer member.

8. An atomizer according to claim 1, wherein the intermediate channels of the same set have respective flow sections that are substantially mutually identical, and wherein the outlet ducts have respective flow sections that are substantially mutually identical.

9. An atomizer according to claim 1, wherein the total flow section of the outlet ducts is greater than or equal to the total flow section of the inlet duct(s), wherein the total flow section of the outlet ducts is greater than or equal to a total flow section of the intermediate channels belonging to the same set, and wherein the total flow section of the intermediate channels belonging to the same set is greater than or equal to the total flow section of the inlet duct(s).

10. An atomizer according to claim 1, wherein the intermediate chambers and the outlet chamber are each of annular shape that is circularly symmetrical about the spraying axis.

11. An atomizer according to claim 8, wherein each intermediate chamber is constituted by an annular groove, and wherein each intermediate channel is constituted by a notch extending parallel to the spraying axis, wherein each groove and each notch is formed by a respective recess in the inner portion and/or in the outer portion, and wherein the outer portion and the inner portion have overall shapes that are mutually complementary, so as to cover each recess entirely.

12. An atomizer according to claim 1, wherein it further comprises at least one ring that is mounted to move in rotation about the spraying axis, and wherein the set of intermediate channels is formed in said moving ring.

13. An atomizer according to claim 1, wherein each intermediate chamber and each intermediate channel are formed by cavities in a porous part.

14. An atomizer according to claim 4, wherein a total flow section of the intermediate channels belonging to a set interconnecting two intermediate chambers axially further from the atomizer member is less than or equal to a total flow section of the intermediate channels belonging to a set interconnecting two intermediate chambers axially closer to the atomizer member.

* * * * *